United States Patent [19]

Stansifer et al.

[11] 4,141,574

[45] Feb. 27, 1979

[54] MEANS FOR LOCKING THREADED NOZZLES TO A FIRE HYDRANT

[75] Inventors: Dennis N. Stansifer, Decatur; Ralph W. Henderson, Maroa, both of Ill.

[73] Assignee: Mueller Co., Decatur, Ill.

[21] Appl. No.: 822,996

[22] Filed: Aug. 8, 1977

[51] Int. Cl.[2] ..... E03B 9/06; F16B 3/00; F16B 39/02; F16B 41/00

[52] U.S. Cl. ..... 285/92; 285/91; 403/280; 403/355; 403/368; 137/296

[58] Field of Search ..... 85/32 K, 11, 21, 22; 151/5, 8, 23, 24, 25 R, 26, 30, 57; 285/81, 91, 92, 80, 82, 89, 90, 39; 403/280, 355, 368, 282, 314, 372; 137/296, 385

[56] References Cited

U.S. PATENT DOCUMENTS

| | | | |
|---|---|---|---|
| 692,572 | 2/1902 | Wilcox | 151/30 |
| 799,975 | 9/1905 | Criste et al. | 403/314 |
| 859,814 | 7/1907 | Hughes | 151/26 |
| 1,086,342 | 2/1914 | Anderson | 151/24 |
| 2,107,550 | 2/1938 | Schmidt | 151/26 |
| 2,318,590 | 5/1943 | Boynton | 285/81 |
| 2,797,109 | 6/1957 | Conrad | 285/81 |
| 2,857,635 | 10/1958 | Maple et al. | 403/282 X |
| 3,390,900 | 7/1968 | McCormick et al. | 285/81 |
| 3,399,910 | 9/1968 | Fawkes | 403/282 |
| 4,000,753 | 1/1977 | Ellis | 285/90 X |

FOREIGN PATENT DOCUMENTS

| | | | |
|---|---|---|---|
| 253122 | 7/1964 | Australia | 403/372 |
| 21076 of | 1909 | United Kingdom | 151/25 R |

*Primary Examiner*—Mervin Stein
*Assistant Examiner*—Carl F. Pietruszka
*Attorney, Agent, or Firm*—Cushman, Darby & Cushman

[57] ABSTRACT

A fire hydrant of either the "dry" barrel type or the "wet" barrel type having an improved means of locking a replaceable hydrant nozzle to the hydrant barrel. The means for locking the hydrant nozzle to the boss of the hydrant barrel prevents removal of the nozzle by unauthorized personnel and it includes an elongated rod member having teeth thereon extending generally transverse of a longitudinal axis of the rod member, the rod member being wedged in a particular manner between the hydrant barrel and the hydrant nozzle after the hydrant nozzle has been inserted therein to a predetermined torque.

6 Claims, 11 Drawing Figures

Fig. 2.
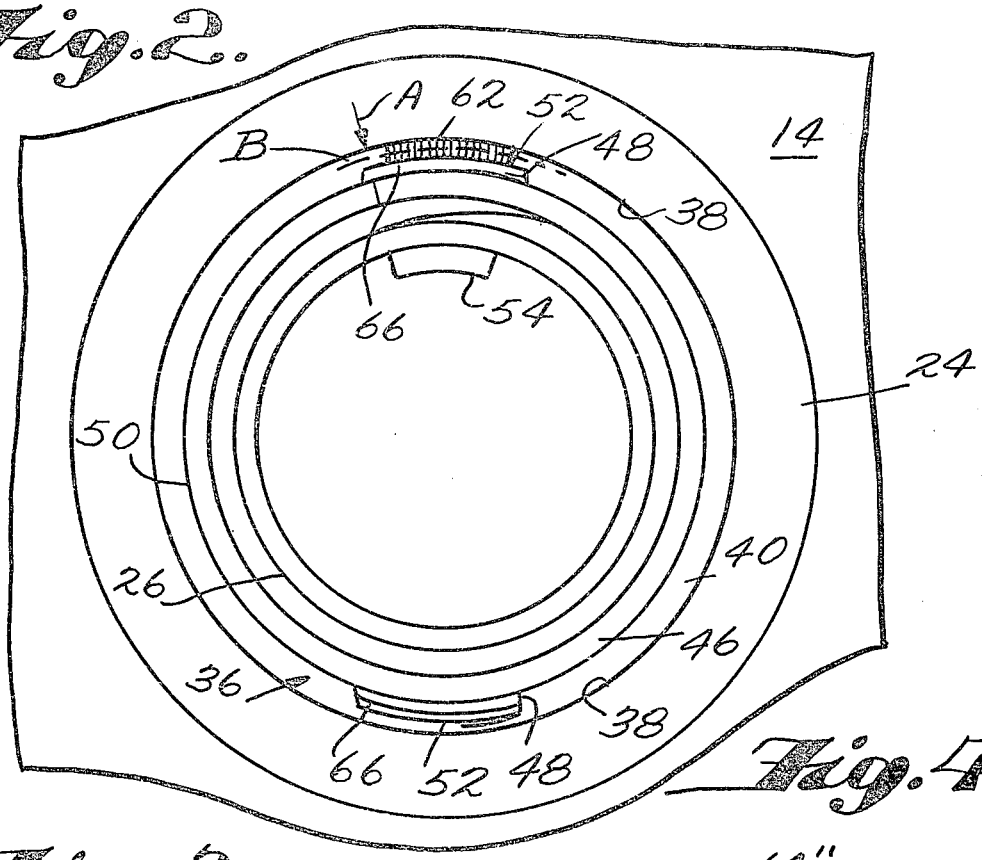
Fig. 4.
Fig. 3.
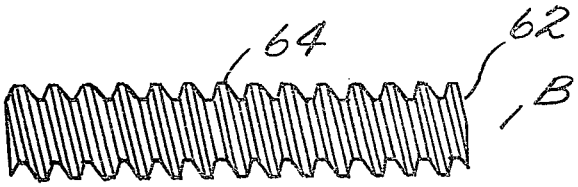
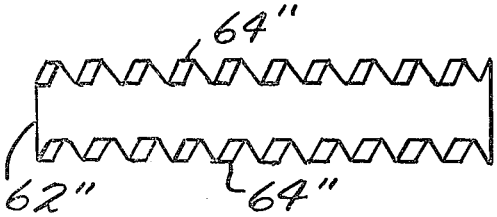
Fig. 4a.
Fig. 3A.
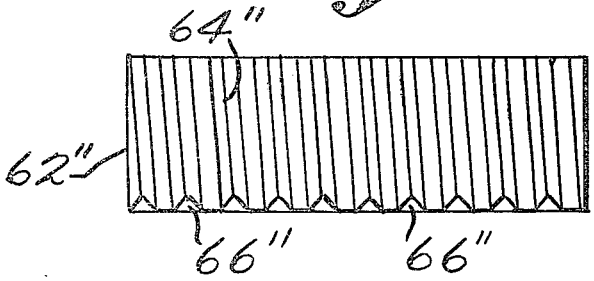
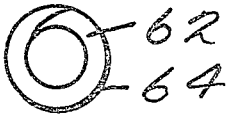
Fig. 4b.
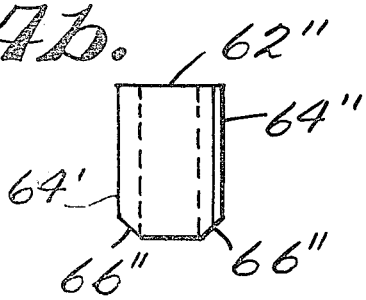

MEANS FOR LOCKING THREADED NOZZLES TO A FIRE HYDRANT

The present invention relates to improvements in fire hydrants, and, more particularly, to an improved fire hydrant nozzle construction wherein the nozzle is threadedly received in the fire hydrant barrel and may be removed, repaired and/or replaced by service personnel but which cannot be removed by unauthorized personnel. In more detail, once the hydrant nozzle has been threaded into the fire hydrant barrel, it is locked in place by means of a rod member having teeth thereon, the rod being wedged or inserted between the nozzle and the boss of the barrel with the rod member being positioned so that all teeth thereon are subjected to a shearing action as is the rod member when an attempt is made by unauthorized personnel to unthread the hydrant nozzle from the barrel.

BACKGROUND OF THE INVENTION

For many years, fire hydrants of the "dry" barrel type have been constructed with brass nozzles inserted into a boss provided on a barrel of the hydrant, the brass nozzles being permanently retained in the boss by calking with lead or the like. In this respect, four inner locking lugs provided on the hydrant nozzle where given a fractional turn from slots in the boss of the barrel when installed and then calked with lead so that the nozzle could not be blown out with water pressure and likewise could not be removed from the hydrant barrel. Consequently, in such a hydrant construction, when it became necessary to replace a nozzle due to damage of the nozzle or wear of the hose threads on the nozzle, it was necessary to remove the entire hydrant barrel with the nozzle thereon and return it to the maintenance shop for repairs or modification.

More recently, hydrants have been constructed with replacement nozzles which could be replaced in situ merely by threading the nozzle out of the boss of the barrel and replacing the nozzle with another nozzle. While such a hydrant arrangment did require a machining operation to the cast iron barrel to provide threads therein, it did add utility to the hydrant in that it provided for quick repairs by maintenance crews of damaged nozzles. However, while this type of construction gave the hydrants considerable more utility from the standpoint of maintenance and also from the standpoint that it permitted change of hydrant nozzles when a community makes a change in size of hose connections, it was found that unauthorized personnel could merely unthread the nozzle from the hydrant barrel and thus the hydrant was not entirely satisfactory.

In order to prevent theft of the valuable brass nozzles and to make the hydrants completely foolproof, early efforts were made to lock the nozzle to the barrel. In this respect, after the nozzle was initially threaded into the boss on the hydrant barrel, radial holes were drilled through the boss and into the hydrant nozzle, and either a blind pin was radially inserted into the aligned holes or the hole in the boss was threaded and a threaded lock pin was inserted into the aligned holes. Although this arrangement functioned to prevent inadvertent removal of the nozzle, it had a drawback in that when it was desired to remove a nozzle for repair it required drilling out of the blind pin and when the nozzle was reinstalled, it was difficult to make the holes in the boss of the barrel and in the nozzle aligned for reception of the locking pin and still have proper torque. Additionally, if the nozzle was to be replaced with a new nozzle, it required drilling at the site of installation to provide a hole in the nozzle which aligned with the hole in the boss on the hydrant barrel.

In a more recent development of hydrants having means for locking replaceable nozzles to the bosses of the fire hydrants, the flange of the hydrant nozzle was provided with at least a portion of its peripheral surface spaced a predetermined distance radially inwardly from the wall of a counterbore in the boss and when the nozzle had been inserted into the boss with the proper torque, a self-tapping stainless steel screw was inserted between the peripheral wall of the counterbore and the peripheral surface of the flange, the screw preventing unthreading. While such an arrangement did increase the amount of torque necessary to remove the nozzle from the barrel, this torque could be overcome by application of a wrench to overcome the locking force of the screw since the threads of the screw were generally in a direction of a radial plane through and normal to the axis of rotation of the nozzle and thus, the threads of the self-tapping screw were not subjected to shear. Often times the screw would roll out when sufficient torque was applied to the nozzle.

PRIOR ART

Prior art relating to fire hydrants and in particular to fire hydrant nozzle constructions having replaceable nozzles are as follows:

| NUMBER | NAME | DATE |
|---|---|---|
| 991,559 | Symons | May 9, 1911 |
| 3,534,941 | Dunton | October 20, 1970 |
| 3,677,282 | Page | July 18, 1972 |
| 4,000,753 | Ellis | January 4, 1977 |

BRIEF SUMMARY OF THE INVENTION

Broadly stated, the present invention relates to an improvement in a fire hydrant, and more particularly, to an improved means of locking a replaceable hydrant nozzle in a boss on a hydrant barrel.

The present invention is disclosed as being used in a nozzle construction of a "dry" barrel type of fire hydrant wherein the main hydrant valve is located in or adjacent to the shoe of the hydrant and is beneath ground level. While the present invention is shown in a "dry" barrel arrangement, it is also capable of use with the "wet" barrel hydrant wherein the hydrant barrel contains the main hydrant valve/valves at or adjacent to the hydrant nozzle/nozzles so that the hydrant barrel is at all times filled with water under pressure. Usually the nozzle for the "wet" barrel fire hydrant contains the valve seat of the main hydrant valve and this necessitates the nozzle being replaceable by authorized personnel from time to time to check the valve seat but locked against removal by unauthorized personnel.

The fire hydrant of the present invention includes a barrel having a bore therethrough terminating at its outer end in a counterbore having a peripheral wall and an outwardly facing radial wall, the bore having interior threads on its inner portion terminating short of the counterbore for receiving a replaceable hydrant nozzle. The hydrant nozzle has an outwardly and radially extending flange intermediate its outer and inner end portion and is provided with exterior threads on its inner end portion for cooperating with the interior threads of the bore in the hydrant barrel and when the nozzle is in place, the flange thereon abuts the radial wall of the counterbore. The flange on the nozzle has at least a portion of its peripheral surface spaced a predetermined distance radially inwardly from the peripheral wall of the counterbore when the nozzle is inserted into the bore of the hydrant barrel. The means for locking the replaceable nozzle to the barrel includes an elongated rod member having teeth thereon extending generally transverse to the longitudinal axis of the rod member. The rod member is inserted into the space between the peripheral wall of the counterbore and the portion of the peripheral surface of the flange, the rod member being bent to conform to the shape of the space and, thus, its longitudinal axis curves coaxially about an axis of the bore whereby each of the teeth on the rod member extend in a general direction of the axis of the bore. When an attempt is made to unthread the nozzle from the bore of the barrel, the positioning of the teeth in this manner results in all of the teeth being simultaneously subjected to shear as well as the rod member itself in a direction of its longitudinal axis.

In one aspect of the invention, the elongated rod member is circular in cross-section and the teeth on the rod member are defined by a continuous thread of predetermined pitch.

In another aspect of the present invention, the rod member is rectangular in cross-section and the teeth are oppositely disposed in an opposite pair of sides of the rod member, the rod member being chamfered along edges of the same to permit easier insertion when driving or wedging into place in space between the peripheral wall of the counterbore and the portion of the peripheral surface of the flange which is spaced a predetermined distance from the peripheral wall.

A still further aspect of the present invention is utilizing an elongated rod member in which the teeth on the rod member are separate from each other and zero pitch.

Another aspect of the present invention is to provide a chamfer on the flange of the hydrant nozzle which forms a channel when the nozzle is initially inserted into the hydrant barrel, the channel assisting in locating the rod member when driving the same into locking position.

These and other objects and advantages of the present invention will appear more fully in the following drawings, Detailed Description of the Invention, and Claims.

BRIEF DESCRIPTION OF THE DRAWINGS

FIG. 2 is an end elevational view of the hydrant nozzle construction of FIG. 1, the view looking from the left to the right of FIG. 1 and omitting the nozzle cap.

FIG. 3 is a side elevational view of a locking rod member for the hydrant nozzle construction of the present invention prior to insertion between the hydrant nozzle and the boss on the barrel of the hydrant.

FIG. 3*a* is an end elevational view of the rod member of FIG. 3.

FIG. 4 is a side elevational view of a modified form of the locking rod member.

FIG. 4*a* is a top plan view of the rod member of FIG. 4.

FIG. 4*b* is an end elevational view of the rod member of FIG. 4 but looking from the left to the right of FIG. 4*a*.

DETAILED DESCRIPTION OF THE INVENTION

Figure 1:
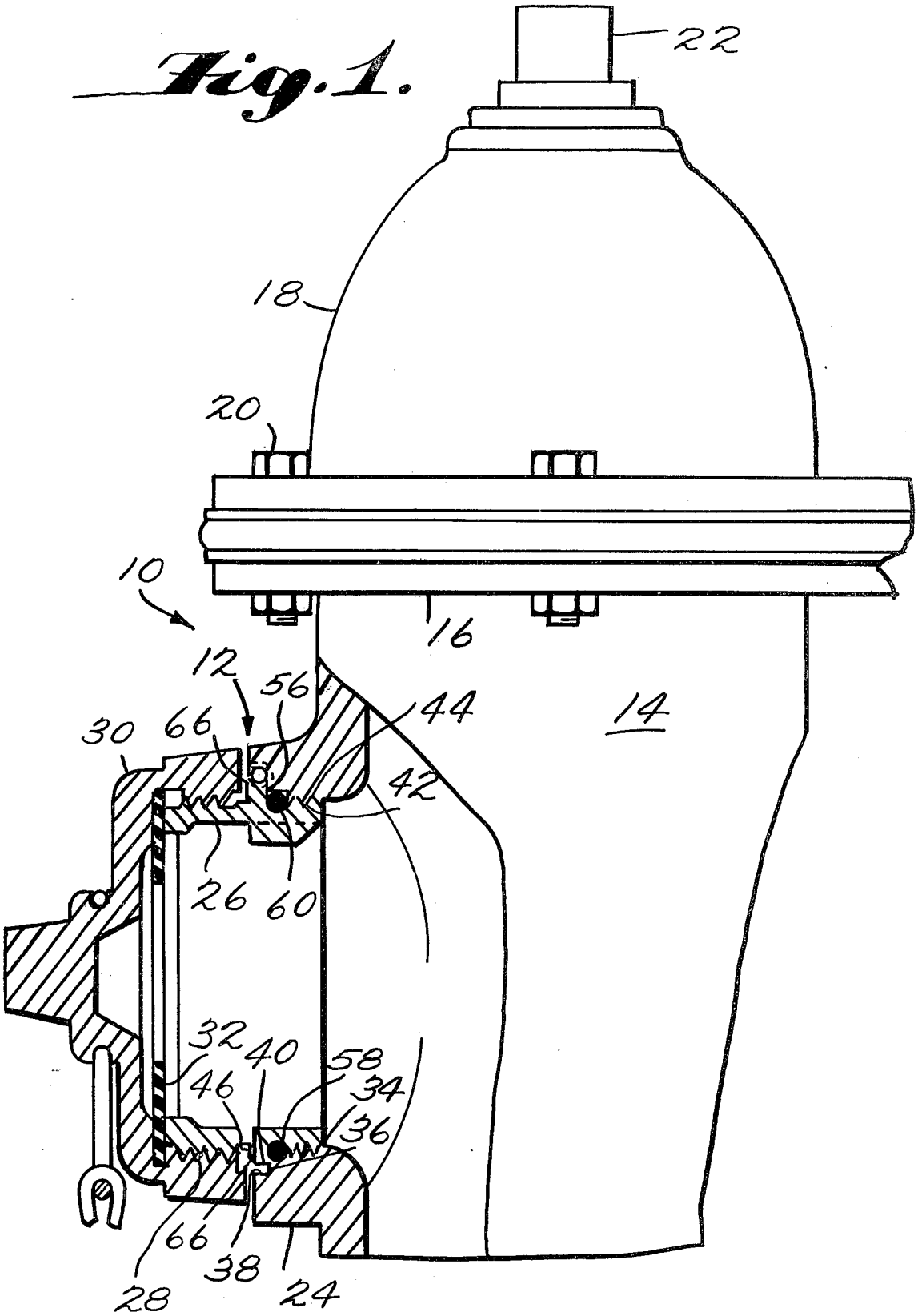
FIG. 1 is a fragmentary side elevational view of the upper portion of a fire hydrant, the view being broken away to illustrate a vertical section through the novel hydrant nozzle construction of the present invention.

Referring now to the drawings wherein like characters and reference numerals represent like or similar parts, there is disclosed in FIG. 1 a fragmentary view of the upper portion of a fire hydrant generally designated at 10, the view illustrating the novel hydrant nozzle construction as generally designated at 12. The fire hydrant includes the usual barrel 14 preferably made of cast iron and having a flanged upper end 16 to which a bonnet 18 is bolted by a plurality of bolts 20. The hydrant is provided with an operating nut 22 operatively connected to a valve stem (not shown), the valve stem being connected in turn to a main hydrant valve assembly located in the hydrant shoe, also not shown. The valve stem may be of the type disclosed in U.S. Pat. No. 4,000,753, issued Jan. 4, 1977 to Daniel A. Ellis and the hydrant shoe and main hydrant valve assembly may be of the type heretofore used in the art or it may be of the type as shown in the U.S. Pat. No. 3,980,096, issued Sept. 14, 1976 to Daniel A. Ellis and Joseph L. Daghe, both patents and this application being commonly assigned to Mueller Co., Decatur, Ill.

As is common practice with fire hydrant barrels, they are provided with one or more outwardly extending bosses 24 for reception of replacement hydrant nozzles 26, the hydrant nozzles being preferably made of brass but could be made of bronze or other materials. The replaceable hydrant nozzle 26 is exteriorly threaded as indicated at 28 on its outer end portion for the reception of a nozzle cap 30 having a cap gasket 32. When the nozzle cap 30 with its cap gasket 32 is removed, the threads 28 are exposed and functioned to receive a hose coupling for a fire hose or the like. The boss 24 of the nozzle construction 12 is provided with a bore 34 therethrough, the bore 34 terminating at its outer end portion in a counterbore 36. The counterbore 36 has a cylindrical peripheral wall 38 and an outwardly facing wall 40 lying in a radial plane of the nozzle 26. Additionally, the bore 34 of the boss 24 is provided with interior threads 42 on its inner end portion, the threads 42 terminating short of the counterbore 36. Of course, if the hydrant barrel 14 has a wall thick enough to be provided with the bore 34, interior threads 42 and counterbore 36, then there is no necessity of the barrel to have bosses.

The brass hydrant nozzle 26 of the present invention is provided on its inner end portion with exterior threads 44 which are adapted to mate with the interior threads 42 of the boss 24 and intermediate the exterior threads 44 and the exterior threads 28 on the outer portion of the nozzle, the nozzle 26 is provided with an outwardly and radially extending flange 46. As best shown in FIG. 2, the flange 46 is generally cylindrical but is provided with at least one arcuate radially extending lug 48 so that the peripheral surface 50 of the flange 46 includes at least a peripheral surface portion 52 which is spaced closer to the peripheral wall 38 of the boss 24 than the remaining portion of the peripheral surface 50. The space between the peripheral surface 52 and the peripheral wall 38 of the boss 24 defines an arcuate groove of predetermined width.

The oppositely disposed lugs 48 serve two functions. First, these lugs 48 are utilized to receive a spanner wrench for insertion or removal of the nozzle 26 from the boss 24. Secondly, the distance A (FIG. 2) between the surface portion 52 of the flange 46 and the peripheral wall 38 of the counterbore 36 is accurately controlled at a predetermined distance for a particular function as will be explained in more detail in the specification. The hydrant nozzle 26 is provided with an inwardly depending lug 54, this lug functioning as a locating means for the chuck used when the nozzle 38 is machined to provide the peripheral surface portion 52 and the threads 28 and 44 thereon.

The hydrant nozzle 26, intermediate the threads 44 and the inwardly facing surface 56 of the flange 46 is provided with an annular groove 58 which closely cooperates with the bore 34 of the boss 24. A sealing ring 60 is positioned in the annular groove 58. It will be noted that when the hydrant nozzle 26 is fully installed in the boss 24, the flange 46 of the nozzle abuts the outwardly facing radial wall 40 of the counterbore 36 and, thus, the sealing ring 60 is completely encompassed between the nozzle and the boss. Since there is metal to metal bottoming of the nozzle 26 in the boss 36, there is no opportunity for the sealing ring 60 to cold flow after a period of extended use, and, consequently, the gripping effect caused by the torque utilized to install the nozzle 26 into the boss 24 never diminishes as would be the case where a sealing ring or gasket is positioned between the flange 46 and the outwardly facing wall 40 of the counterbore 36.

In the aforementioned Mueller Co. U.S. Pat. No. 4,000,753, the means for locking the hydrant nozzle to the hydrant barrel involved utilizing a stainless steel self-tapping screw inserted between the peripheral wall of the counterbore and the peripheral surface portion of the lug on the flange. The self-tapping screw was either driven in place by a hammer or screwed into place but in both instances, the screw had its axis parallel to the axis of rotation of the nozzle. While the screw did function to increase the torque necessary to remove the hydrant nozzle from the barrel, the threads of the screw could not take a maximum torque and their holding action was not cumulative. Additionally, someone with a screwdriver could easily unscrew the self-tapping screw so as to remove the same and permit normal removal of the nozzle.

In the present invention, a locking means in the form of a stainless steel elongated rod member 62 having teeth 64 thereon is driven between the peripheral surface portion 52 of the lug 48 and the peripheral wall 38 of the counterbore 36 in the boss of the hydrant barrel. The elongated rod member 62 prior to insertion, has a straight longitudinal axis B as shown in FIG. 3 but when the rod member 62 is driven or wedged into position as shown in FIG. 2, it will be bent or curved to assume the arcuate shape of the space between the peripheral wall and the peripheral surface portion 52 so that the longitudinal axis B is curved concentrically about the axis of rotation of the nozzle 26. The distance A, which is a radial distance between the peripheral surface portion 52 and the wall 38 of the arcuate groove is accurately controlled by machining the peripheral surface portion 52 of the lug and the elongated rod member 62 must have a width defined between the crest of oppositely disposed teeth 64 greater than the distance A with the root thickness between oppositely disposed teeth being slightly less than but also preferably greater than the distance A.

Since the elongated rod member 62 must be wedged inwardly into the arcuate space between the peripheral surface portion 52 and the peripheral wall 38, the lug 48 is provided with a chamfer 66 to aid in driving the rod member into place. Any suitable tool having a flat, blunt end may be used in driving the rod member 62 into place either by driving the entire rod in at once or by driving in one end of rod member first with the rest being progressively driven in place. By having the teeth 64 of the rod member 62 extending in the same general direction as the axis of the nozzle, there is room for the brass of the hydrant nozzle to flow out of the way when inserted. Additionally, the teeth 64 of the locking rod member 62 being oriented as described when inserted between the nozzle and the barrel provides a cumulative effect in retaining the hydrant nozzle 26 against removal from the barrel as each tooth of the rod member as well as the body of the rod member is placed under shear simultaneously with the body of the rod member having the shear in the direction of its longitudinal axis rather than its width.

Figure 5:
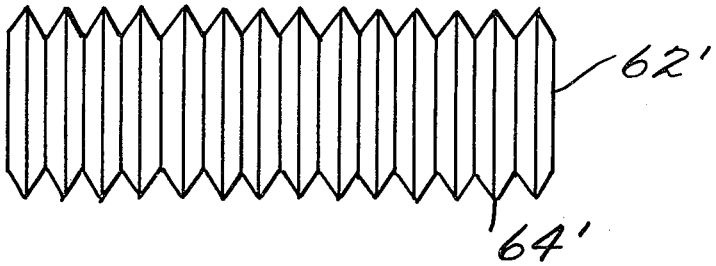
FIG. 5 is a still further modification of the locking rod member.

The rod member shown in FIG. 3 has its teeth 64 defined by a continuous thread having a predetermined pitch. On the other hand, the rod member 62' of FIG. 5 is provided with teeth 64' normal to the longitudinal axis of the rod member 62' and, thus, the teeth are separate from each other.

Referring to FIG. 4, there is shown a modification of rod member, this being the rod member 62'' which is generally rectangular in cross-section and which is provided with teeth 64'' that are oppositely disposed on a pair of opposite sides of the same. The teeth 64'' preferably have a predetermined acute angle with respect to the longitudinal axis of the rod member 62'' although they could be normal to such axis. The rod member 62'' is chamfered along its edges at 66'' to provide an assistant when the rod member is drivingly inserted into place.

Tests have been run to determine the approximate removal torque necessary to shear the locking rod members of the types shown in FIGS. 3 and 4 and these tests clearly emphasize the substantial increase in torque necessary to remove hydrant nozzles locked by the elongated rod members over hydrant nozzles locked by self-tapping screws such as shown in the aforementioned U.S. Pat. No. 4,000,753. As will be noted in the aforementioned patent, the test results were given for approximate removal torque in inch pounds whereas the test results shown below are given in foot pounds.

A series of tests were made utilizing a cylindrical rod member 62 such as that shown in FIG. 3, the cylindrical rod member having threading thereon in accordance with standards set by ANSI (American National Standards Institute) B18.6.4-1966 for a #6 Type A Thread Forming Tapping Screw. The rod 62 had 18 threads per inch and had a crest diameter of 0.136 to 0.141 inches with a root diameter of 0.096 to 0.102. The rod member was made of #416 stainless steel having a hardness Rockwell "C" 40. The hydrant nozzle upon which the test was made was a 2½ inch diameter nozzle, the smallest of those used on standard fire hydrants, and the test results are shown in the following table:

| 2½ inch nozzle installed into barrel boss and locked with an elongated locking rod member of #416 stainless steel #6 type A thread with 18 threads per inch and having a hardness Rockwell "C" 40 | | | |
|---|---|---|---|
| Test No. | Nozzle Installation Torque | Gap Width A | Removal Torque |
| 1 | 600 ft. lbs. | .080" | 950 ft. lbs. |
| 2 | 600 ft. lbs. | .111" | 735 ft. lbs. |
| 3 | Hand tight | .111" | 430 ft. lbs. |

A second test was conducted on a 2½ inch hydrant nozzle installed into a hydrant barrel, the tests utilizing a cylindrical rod member having a special thread form to define the teeth. There were 13 threads per inch with the threads having a crest diameter of 0.164 to 0.174 inches and a root diameter of 0.085 to 0.095 inches. The material of the rod member was #416 stainless steel with a hardness Rockwell "C" 40. The test results for various gap widths are shown in the following table:

| 2½ inch nozzle installed into barrel boss and locked with an elongated locking rod member of #416 stainless steel type A thread with 13 threads per inch and having a hardness Rockwell "C" 40 | | | |
|---|---|---|---|
| Test No. | Nozzle Installation Torque | Gap Width A | Removal Torque |
| 1 | 600 ft. lbs. | .077" | 1039 ft. lbs. |
| 2 | 600 ft. lbs. | .113" | 932 ft. lbs. |
| 3 | Hand tight | .082" | 538 ft. lbs. |
| 4 | Hand tight | .108" | 717 ft. lbs. |

A final test was conducted on an elongated rod member of the type shown in FIG. 4, this test also being conducted with a 2½ inch nozzle on a hydrant barrel. The elongated rod member which was rectangular in cross-section had a crest width between the teeth of 0.164 to 0.174 inches and a root width between 0.085 and 0.095 inches and there were 13 teeth per inch. The material of the rod member was #416 stainless steel with a hardness Rockwell of "C" 40 and the test results were as follows:

| 2½ inch nozzle installed into barrel boss and locked with an elongated locking rod member of #416 stainless steel with 13 teeth per inch and having a hardness Rockwell "C" 40 | | | |
|---|---|---|---|
| Test No. | Nozzle Installation Torque | Gap Width A | Removal Torque |
| 1 | 600 ft. lbs. | .103" | 788 ft. lbs. |
| 2 | 600 ft. lbs. | .071" | 968 ft. lbs. |

Figure 6:
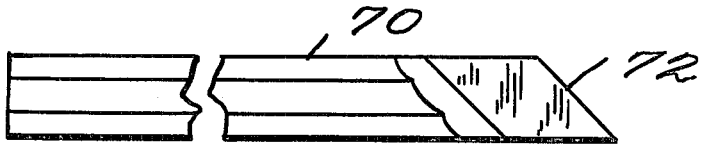
FIG. 6 is a side elevational view of a tool for removal of the locking member.
Figure 7:
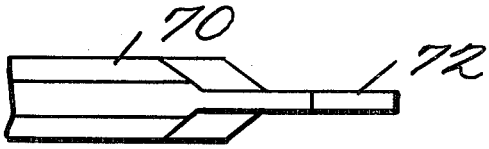
FIG. 7 is a fragmentary plan elevational view of the tool of FIG. 6.
Figure 8:
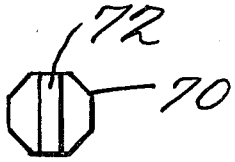
FIG. 8 is an end elevational view of the tool of FIG. 6 looking from the right to the left thereof.

To remove the locking rod member when it is desired to remove, repair or replace the hydrant nozzle from the hydrant barrel, it is necessary that a special tool such as the awl 70 shown in FIGS. 6 to 8 be used. The awl 70 has a case hardened pointed end 72 which is inserted under one end of the rod member and tapped with a hammer to lift the same. The rod member may then be progressively pried out of the arcuate space defined between the peripheral surface portion of the lug and the peripheral wall of the counterbore of the boss. When the nozzle has been repaired and replaced, the opposite lug may be used to retain a newly inserted locking rod member.

The terminology used in the specification is for the purpose of description and not limitation, as the scope of this invention is defined in the claims.

What is claimed is:

1. In a fire hydrant comprising a barrel having a bore therethrough terminating at its outer end portion in a counterbore having a peripheral wall and an outwardly facing radial wall, said bore having interior threads on its inner portion terminating short of said counterbore; a replaceable nozzle having an outwardly and radially extending flange intermediate its outer and inner end portions and arranged to be threadedly received in said counterbore, said flange having at least a portion of its peripheral surface spaced radially inwardly a predetermined distance from the peripheral wall of said counterbore, said nozzle having exterior threads on its inner end portion for receiving the interior threads of said boss; and means engaging said peripheral wall of the counterbore of said barrel and said portion of the peripheral surface of flange of said replaceable nozzle for locking said replaceable nozzle to said barrel;

the improvement in locking means comprising an elongated rod member of circular cross-section and having a continuous thread of predetermined pitch thereon defining teeth extending generally transverse of a longitudinal axis of said rod member, said rod member positioned between said peripheral wall of said counterbore and said at least a portion of the peripheral surface of said flange with its teeth engaging the same and its longitudinal axis curved coaxially about an axis of said counterbore whereby each of said teeth on said rod member is simultaneously subjected to shear when an attempt is made to unthread said nozzle from the bore of said barrel.

2. A fire hydrant as claimed in claim 1 in which the portion of the peripheral surface of said flange is provided with a chamfer to form a channel for locating and guiding said rod member during insertion into locking position.

3. A fire hydrant as claimed in claim 1 in which said rod is stainless steel having a hardness of Rockwell "C" 40, and in which said barrel is made of cast iron and said nozzle is made of brass.

4. A fire hydrant as claimed in claim 1 in which said flange is provided with oppositely disposed radially extending nozzle lugs defining the portion of the peripheral surface of the flange spaced the predetermined distance from the peripheral wall of the counterbore.

5. A fire hydrant as claimed in claim 4 in which each of said nozzle lugs is chamfered.

6. A fire hydrant as claimed in claim 4 in which said rod member is positioned between and engaging the peripheral surface of one of said lugs and the peripheral wall of said counterbore.

* * * * *